United States Patent [19]

Hosoya et al.

[11] Patent Number: 4,637,223

[45] Date of Patent: Jan. 20, 1987

[54] PACKAGED TERMINAL AIR-CONDITIONER

[75] Inventors: Yoshinori Hosoya; Shyozi Tunekawa; Wazoh Yamada; Akira Shiraishi, all of Gunma, Japan

[73] Assignees: Sanyo Electric Co., Ltd.; Tokyo Sanyo Electric Co., Ltd., both of Japan

[21] Appl. No.: 756,020

[22] Filed: Jul. 17, 1985

[30] Foreign Application Priority Data

Jul. 19, 1984 [JP] Japan ..... 59-149959

[51] Int. Cl.[4] ..... F25D 23/12

[52] U.S. Cl. ..... 62/263; 62/298

[58] Field of Search ..... 62/263, 259.1, 409, 62/DIG. 16, 298

[56] References Cited

U.S. PATENT DOCUMENTS 4,281,522 8/1981 Bussjager ..... 62/263

*Primary Examiner*—Henry Bennett

*Attorney, Agent, or Firm*—Darby & Darby

[57] ABSTRACT

A packaged terminal air-conditioner comprises a housing which includes a cabinet, a bottom plate and front cover attached to the front of the cabinet being mounted through a house wall and the like. On the front side of the bottom plate, there is provided a fan casing unit having a partition which divides an inside of the housing into indoor and outdoor sections. A propeller fan and an outdoor heat exchanger are arranged in the outdoor section, while in the indoor section, a cross-flow fan is mounted in the front vicinity of the partition of the fan casing unit and extending in parallel with the surface of the partition and an indoor heat exchanger is arranged in front of the fan casing unit. The partition serves both an air guide portion for guiding an indoor air heat-exchanged to the cross-flow fan and a scrolling portion of the cross-flow fan for producing an air stream. In assembling, the cross-flow fan is mounted on the supporting portion of the fan casing unit, then the indoor-heat exchanger is mounted on the fan casing unit, the fan casing unit is placed on the bottom plate on which the outdoor heat exchanger and the propeller fan are mounted in advance, thereafter the bottom plate is inserted into the cabinet and the front cover is attached to the cabinet.

3 Claims, 4 Drawing Figures

PACKAGED TERMINAL AIR-CONDITIONER

BACKGROUND OF THE INVENTION

1. Field of the Invention

The present invention relates to a packaged terminal air-conditioner. More specifically, the present invention relates to a packaged terminal air-conditioner mounted through a house wall and the like.

2. Description of the Prior Art

One example of a packaged terminal air-conditioner is disclosed, for example, in U.S. Pat. No. 3,741,290.

According to the U.S. Patent, a chassis constituted by a pair of side-walls and a partition connecting the side-walls is provided and an inside of a housing is divided into indoor and outdoor sections by the partition. In each section, equipments such as a heat exchanger, a blower and a fan casing of the blower and so on are disposed separately, thereby the packaged terminal air-conditioner is constructed.

In the prior art described above, since each equipment is adapted to be assembled successively on the chassis arranged in the housing, it may occur that these equipments mounted on the chassis while a spacing can not be kept as designed. Particularly, if the clearance between a fan and a fan casing is not retained precisely as designed, it may result in a reduction of air quantity or an increase of noise.

Moreover, since the partition is mounted on the chassis in the one-body fashion, in checking the equipments such as the outdoor heat exchanger and the propeller fan, the air-conditioner is to be drawn out from the wall and put on the floor, therefore the work for checking was troublesome.

SUMMARY OF THE INVENTION

Therefore, a principal object of the present invention is to provide a packaged terminal air-conditioner having a construction which can solve problems caused by a constructional order, particularly in assembling a cross-flow fan.

Another object of the present invention is to provide a packaged terminal air-conditioner capable of being checked or tested or service easy.

In brief, the present invention is a packaged terminal air-conditioner comprising a housing the inside thereof being divided into an indoor section at which an indoor air is circulated and an outdoor section at which an outdoor air is circulated, a cabinet constituting said housing, a bottom plate provided in the bottom of said cabinet, a cross-flow fan for circulating the indoor air, a fan casing unit mounted on said bottom plate, which includes a partition having an air guide portion for guiding the indoor air to said cross-flow fan and a scrolling portion of said cross-flow fan and for dividing the inside of said cabinet into said indoor section and said outdoor section, a supporting portion formed at lateral ends of said fan casing unit for supporting said cross-flow fan and an indoor heat exchanger being arranged in front of said fan casing unit.

According to the invention, since the partition of the fan casing unit serves also as a scrolling portion of the cross-flow fan, a clearance error between the surface of the fan blade and the scrolling portion in assembling of the air-conditioner can be eliminated. More specifically, in the invention, since the air-conditioner can be assembled by placing the fan casing unit mounted with the cross-flow fan in advance so as to maintain a predetermined clearance between the cross-flow fan and the indoor side surface of the partition, on the bottom plate and inserting it into the housing, not only the assembling can be simplified but also the clearance between the cross-flow fan and the fan casing may be retained as designed. Therefore, according to the present invention, the reduction of air quantity and the increase of noise caused by an error of the spacing between the cross-flow fan and the scrolling portion thereof.

Moreover, the fan casing unit may be detachable from the bottom plate in the state where the cross-flow fan is mounted on the same in one-piece fashion. Therefore, it is possible to check or test the air-conditioner being mounted through a house wall.

These objects and other objects, features, aspects and advantages of the present invention will become apparent from the following detailed description of the embodiments of the present invention when taken in conjunction with accompanying drawings.

DESCRIPTION OF THE PREFERRED EMBODIMENTS

Figure 1:
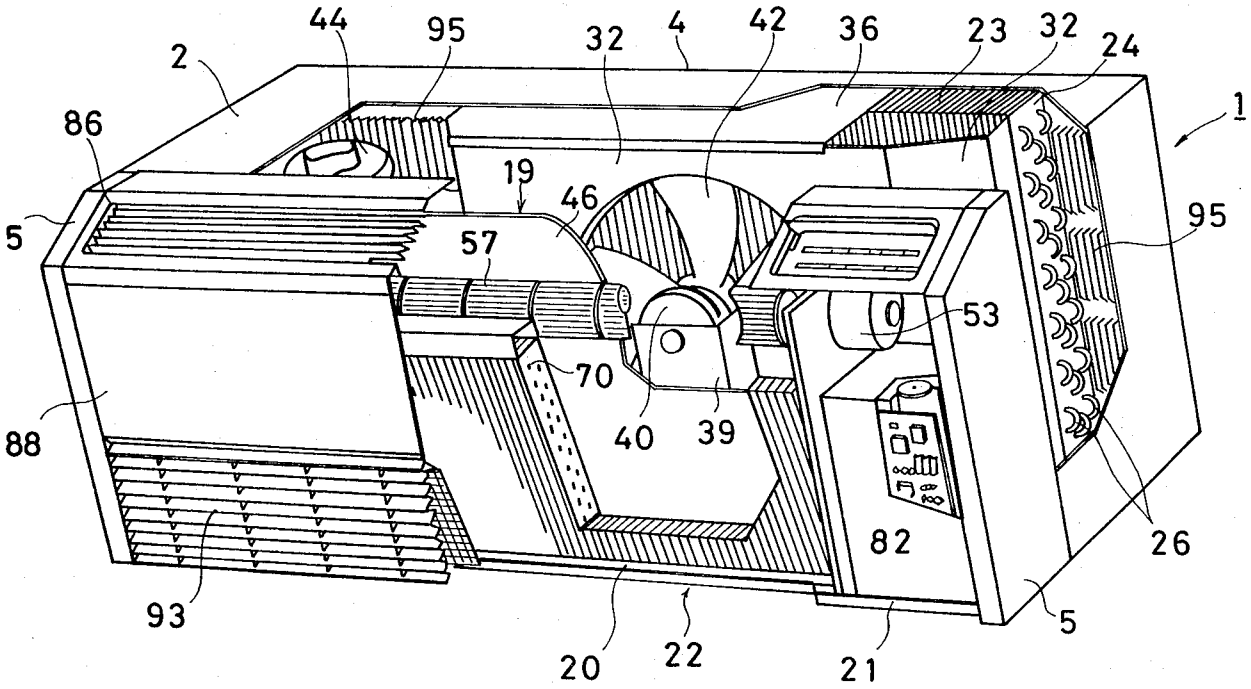
FIG. 1 is a partially cutaway perspective view showing a construction of one embodiment of the present invention.

FIG. 1 is a partially cutaway perspective view showing an internal structure of one example of the present invention. A packaged terminal air-conditioner 1 is constructed so as to draw indoor air from a grille 93 of a front panel 88 and a dent portion 33 of the bottom plate, which is heat exchanged by a refrigerant flowing through an indoor heat exchanger 70 and flowed into the room through an air outlet 86, while outdoor air is drawn through the rear both sides and discharged from the center of the rear surface as shown in FIG. 1.

Figure 2:
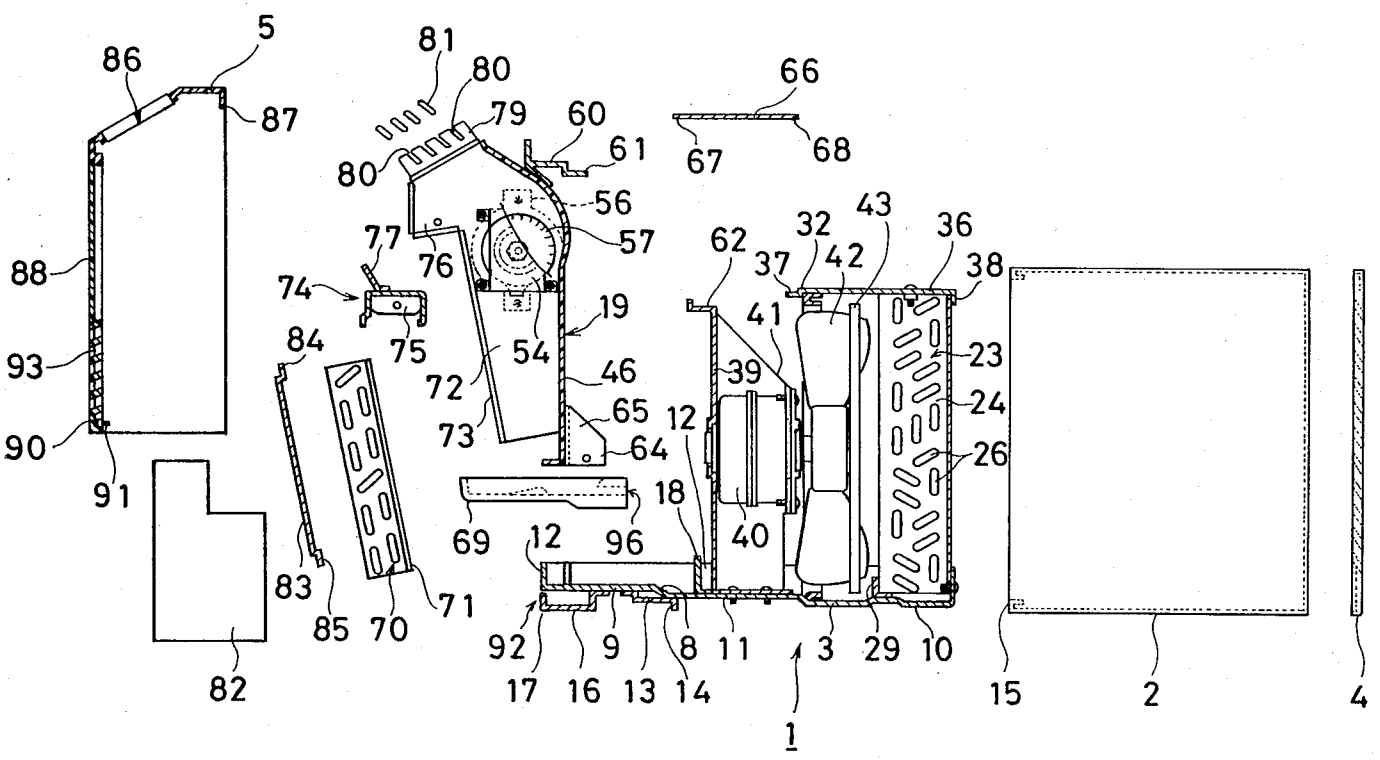
FIG. 2 is an explosive view showing major components of the embodiment.

The packaged terminal air-conditioner 1, as shown in FIG. 2 in explosion, comprises a cylindrical cabinet 2 having a rectangular section, the bottom plate 3, whereon the refrigerant equipment to be described later being placed and inserted into the cabinet 2, rear grille and front cover 4 and 5 mounted, on the rear and front of the box 2.

A housing 98 (FIG. 3) is constituted by the cabinet 2 and the front cover 5 attached to the front of the cabinet.

Figure 3:
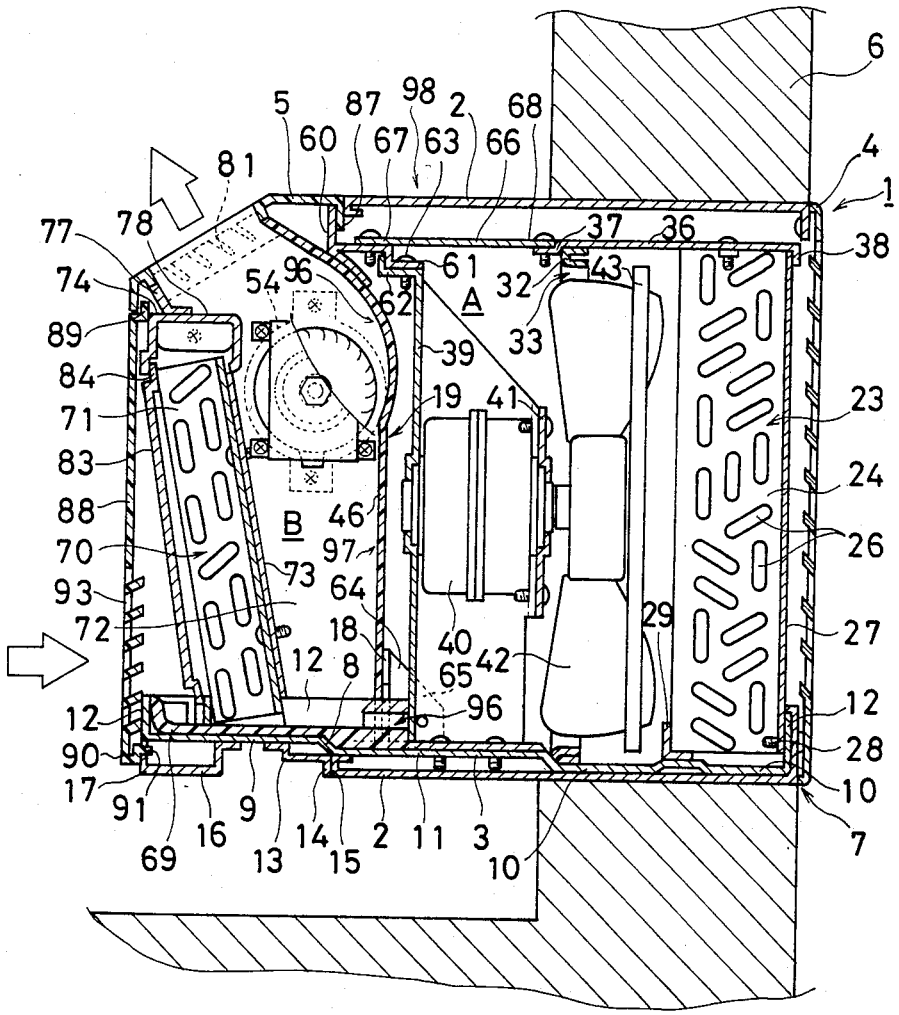
FIG. 3 is a longitudinal sectional view of the embodiment.

The cylindrical cabinet 2, as particularly apparent from FIG. 3, is inserted into a through hole 7 formed through a house wall 6 whereby the packaged terminal air-conditioner 1 may be mounted on the wall 6.

The bottom plate 3 is divided by a partition 46 of a fan casing unit 19 to be described later, into an indoor side bottom portion 9 in the front and outdoor bottom portion 10 in the rear thereof. The indoor side bottom portion 9 is formed higher than the outdoor side bottom portion 10 by a step 8. On a mounting portion 11 generally, in the center of the bottom plate 3 and protruding from the outdoor side bottom portion 10, a blower mounting pedestal 39 to be described later is installed. A rise wall 12 bent upwardly at the entire peripheral edge of the bottom plate 3 is formed.

A stopper member 13 is provided beneath the indoor side bottom portion 9. When inserting the bottom plate 3 into the cabinet 2, a rear end 14 of the stopper member 13 becomes in abutment with an edge 15 of a front opening of the cabinet 2, thereby ensuring the positioning of the bottom plate 3.

A mounting member 16 for mounting the front cover 5 is fixed on the rear surface of the indoor side bottom portion 9 and a front end 17 thereof is substantially in coincidence with the rise wall 12 of the front of the bottom plate 3. A positioning piece 18 is provided on the bottom plate 3 as shown in FIG. 2, to which a lower portion of a fan casing unit 19 is contacted.

As clearly understood from FIG. 1, a center portion 20 on a front edge of the bottom plate 3 is dent inwardly from the both sides 21 so as to draw the indoor air into the machine from a dent portion 22.

Figure 4:
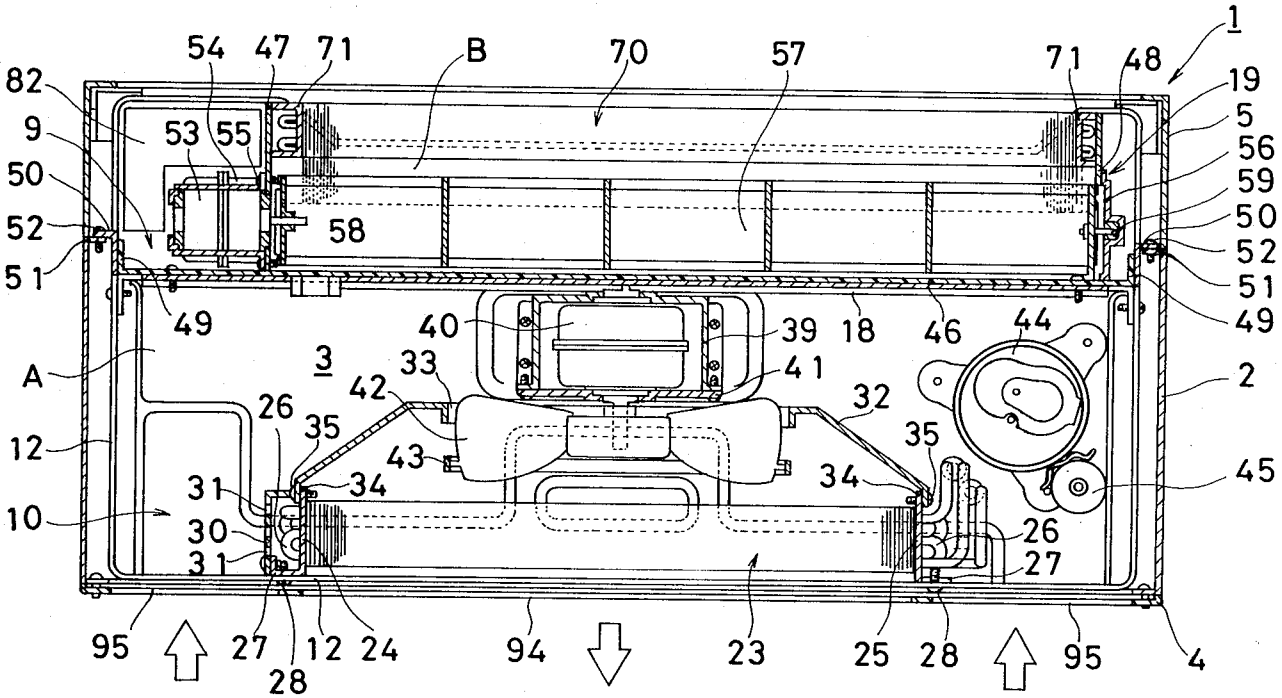
FIG. 4 is a transverse sectional view of the embodiment.

The outdoor heat exchanger 23 is mounted on the rearmost end of the bottom plate 3 and substantially L-shaped tube plates 24 and 25 are disposed on both sides thereof as apparent from FIG. 4, from these tube plates, U-tubes 26 wherein the refrigerant flows, are protruded outwardly. Short side 27 of the tube plates 24 and 25 are secured to the rise wall 12 on the rear portion of the bottom plate 3 with screws 28. A guide plate 29 having a L-shaped section is disposed so as to cover the entire width of the front lower portion of the outdoor heat exchanger 23. The guide plate 29 is for guiding frost and drain deposited to and dropped from fins of the outdoor heat exchanger 23 to the inside when the outdoor heat exchanger 23 is used as an evaporater, that is, in a cooling operation, thereby preventing the frost to hit an propeller fan 42 to be described later.

A number of air holes 31 are opening in a protective member 30 (FIG. 4) of the U-tubes 26 on one side in the lateral direction of the outdoor heat exchanger 23 and the outdoor air passing into the protective member 30 through holes 31 is heat-exchanged with the refrigerant flowing through the U-tubes 26. The protective member 30 is fixed to the tube plate 24 and covers all U-tubes 26 projecting on that side. In front of the outdoor heat exchanger 23, that is, behind the propeller fan 42, there is provided an outdoor fan casing 32 so as to cover the propeller fan 42. In the center of the fan casing 32, a circular opening 33, wherein the propeller fan 42 being arranged, is formed and the both ends thereof are secured to long side 34 of the tube plate 24 and 25 with screws 35. A top plate 36 is mounted so as to cover the upper portions of the outdoor fan casing 32 and the outdoor heat exchanger 23, and a bent portion 37 formed on the front of the top plate 36 is engaged with the upper edge of the outdoor fan casing 32, and a bent portion 38 formed on the rear portion of the top plate 36 is engaged with the upper portion of the outdoor heat exchanger 23.

As previously mentioned, the blower mounting pedestal 39 having a U-shaped plan is fixed on the mounting portion 11 of the bottom plate 3, wherein, as clearly understood from FIG. 4, a motor 40 is contained and sustained by a side plate 41. The propeller fan 42 as the outdoor blower mounted on the shaft of the motor 40 is positioned so as to be arranged in the opening 33 of the outdoor fan casing 32. On the periphery of the propeller fan 42, a slinger ring 43 is formed, which sprays drain collected on the bottom plate 3 onto the outdoor heat exchanger 23. More specifically, in the cooling operation, the drain is collected on the outdoor side bottom portion 10 and sprayed onto the outdoor heat exchanger 23 by the rotation of the slinger ring 43, thereby accelerating the cooling of the refrigerant flowing therethrough and the drain is evaporated.

A compressor 44 (FIG. 4) is mounted on the bottom plate 3 via a vibration preventing means (not shown). An accumulator 45 is secured to a side wall of the compressor 44.

On the indoor side bottom portion 9 of the bottom plate 3, a fan casing unit 19 forming a distinctive feature of the present invention, is disposed. The casing unit 19 includes the partition 46 having a height generally equal to the height of the cabinet 2 and side plates 47 and 48 extending forwardly from both lateral ends thereof. An upper portion of the partition 46 constituting the fan casing unit 19 is curved along the external surface of the cross-flow fan 57 to be described later and serves as the scrolling portion 96 thereof. A lower portion of the partition 46 is formed generally vertically and serves as an air guide portion 97 for guiding indoor air drawn through a lower end portion of the fan casing unit 19 upwardly. On both sides of the partition 46, as clearly understood from FIG. 4, the side plates 47 and 48 described above are mounted integrally by means of welding and the like. Also, flanges 50 having an L-shaped section are connected to both side bent portions 49 of the partition 46 and secured to a front edge 51 of the cabinet 2 with screws 52. The partition 46 is mounted on the bottom plate 3 freely detachably and the partition 46 divides above the bottom plate 3, namely, inside the cabinet 2 into an outdoor section A and an indoor section B.

A motor 53 (FIG. 4) is secured to the side plate 47 by the mounting legs 54 with screws 55. A bearing 56 is secured to the side plate 48, one axis of the cross-flow fan 57 is coupled to an axis 58 of the motor 53 and another axis 59 is inserted into the bearing 56. In such a manner, the cross-flow fan 57 is sustained generally in parallel with the surface of the partition 46 axially by the side plate 47, the bearing 56 of the side plate 48 secured to the partition 46 and the motor 53. Thus, the cross-flow fan 57 may be so assembled that the clearance between the surface of the cross-flow fan 57 and the inner surface of the partition 46, i.e. the scrolling portion 96 will be maintained always as designed. The cross-flow fan 57 includes side plates and blades mounted between side plates.

On the generally upper center of the partition 46, an upper mounting piece 60 is secured and a tip 61 thereof is secured to an upper portion 62 of the blower mounting pedestal 39 with screws 63. On both lower ends of the partition 46, lower mounting piece 64 are secured and side walls 65 thereof are fixed to the rise wall 12 of the side of the bottom plate 3. An auxiliary metal piece 66 is fixed respectively to the upper mounting piece 60 at one end 67 and to the upper plate 36 at the other end 68, thereby the clearance between the fan casing unit 19 and the outdoor fan casing 32 is fixedly retained.

A drain pan 69 made of foam styrol is placed on the indoor side bottom portion 9 of the bottom plate 3 and a drainage outlet 96 of the drain pan 69 is directed into the outdoor section A through the partition 46.

The indoor heat exchanger 70 is disposed in front of the fan casing unit 19. The indoor heat exchanger 70 includes right and left tube-plates 71, which are fixed to front edges 73 of side walls 72 of the fan casing unit 19. On the top of the indoor heat exchanger 70, a stabilizer 74 is disposed and vertical walls 75 thereof are secured to side walls 76. Also, on an upper surface 78 of the stabilizer 74, a guide plate 77 is secured, which is positioned generally in parallel with the upper portion of the partition 46 and preventing blowed air from flowing in toward the indoor heat exchanger 70.

On an outlet of the fan casing unit 19, as clearly understood from FIG. 2, a mounting member 79 is mounted and louvers 81 are inserted into concave grooves 80 thereof. The lovers 81 guide the air heat-exchanged by the indoor heat exchanger 70 obliquely forward of the outlet. Meanwhile, when guiding the air upward of the outlet, the louvers 81 may be inserted into the concave groove 80 after mounting the mounting member 79 to the outlet by reversing the front and rear thereof sop as to bring the openings of the concave grooves 80 to face upward.

On one side of the indoor section B, an electrical components box 82 arranged in front of the motor 53 mentioned above, and containing electrical components therein is mounted.

In front of the indoor heat exchanger 70, an air filter 83 is provided and an upper portion 84 thereof is inserted into a gap between the stabilizer 74 and the indoor heat exchanger 70, while a lower portion 85 is inserted into a gap between the drain pan 69 and the rise wall 12.

The front cover 5 covers both sides and the upper portion of the indoor section B, the indoor heat exchanger 70 and the fan casing unit 19 are housed and the aforementioned air outlet 86 is opened thereupon. The air outlet 86 is provided with the mounting member 79 mentioned above. An upper edge 87 of the front cover 5 is engaged with the upper mounting piece 60. An upper portion 89 of a front panel 88 is inserted into a gap between the front cover 5 and the stabilizer 74 and a protrusion 91 of a lower portion 90 thereof is engaged with an engaging hole 92 of the front cover mounting member 16. Then, a suction grille 93 is formed on the front panel 88.

On the rear grille 4, as clearly understood from FIG. 4, an outlet 94 and inlets 95 are formed respectively in the center and on the both sides of the outlet 94.

When the packaged terminal air-conditioner 1 having such construction is operated, in the outdoor section A, the outdoor air is drawn through the both inlets 95 by the rotation of the propeller fan 42 and guided to the opening 33 along the outer wall of the outdoor fan casing 32. Thereafter, the air is led to the outdoor heat exchanger 23 and heat-exchanged with the refrigerant flowing therethrough. Moreover, the drain collected on the bottom plate 3 is sprayed to the outdoor heat exchanger 23 by a rotation of the slinger ring 43, a heat-exchange of the refrigerant is accelerated by the drain. Thus, the outdoor air is circulated from the inlets 95 to outlet 94.

Meanwhile, in the indoor section B, the indoor air is drawn through the suction grille 93 of the front panel 88 and the dent portion 22 of the bottom plate 3 by the rotation of the cross-flow fan 57 and heat-exchanged with the refrigerant flowing through the indoor heat exchanger 70. Thereafter, the heat-exchanged air is guided upward along the partition 46 of the fan casing unit 19 and flowed out from the air outlet 86 through the lovers 81. Thus, the indoor air is circulated from the suction grille 93 and dent portion 22 to the air outlet 86.

As described above, since the cross-flow fan 57 is mounted on the predetermined position of the fan casing unit 19 so that the clearance between the cross-flow fan and the scrolling portion 96 is kept so as to fully exhibit the property of the cross-flow fan 57, and the fan casing unit 19 thus mounted is placed on the bottom plate 3, in assembling the packaged terminal air-conditioner 1, each equipment, in particular, the cross-flow fan, becomes easier as compared with the prior art and also the assembly error thereat may be minimized.

Furthermore, since the partition 46 divides the upper portion of the bottom plate 3, that is, inside the housing 98 into indoor and outdoor sections only by placing and fixing the fan casing unit 19 on the bottom plate 3, a special partition is not required and the efficiency of assembling work can be further improved.

Moreover, since the indoor heat exchanger 70 and the fan casing unit 19 are exposed from the housing 98 only by detaching the front cover 5, checking of these equipments is very easy. Furthermore, if the indoor heat exchanger 70 and the fan casing unit 19 are displaced toward the side, it is possible to check the outdoor heat exchanger 23 and the propeller fan 42 from the front side of the housing 98 and to test these equipments being housed in the housing 98 for confirmation whether an accident occurs or not. Since it is possible to check the air-conditioner in the state where the cross-flow fan 57 is mounted on the fan casing unit 19, the clearance between the cross-flow fan 57 and the scrolling portion 96 thereof is maintained the optimum condition as initially mounted.

Although the present invention has been described and illustrated in detail, it is clearly understood that the same is by way of illustration and example only and is not be taken by way of limitation, the spirit and scope of the present invention being limited only by the terms of the appended claims.

What is claimed is:

1. A packaged terminal air conditioner, comprising:

a housing;

a bottom plate provided in a bottom of the housing;

a fan casing unit mounted on the bottom plate and including a partition which divides the interior of the housing into an indoor section, which is adapted to allow indoor air to flow therethrough, and an outdoor section, which is adapted to allow outdoor air to flow therethrough;

a cross-flow fan mounted in the fan casing unit for circulating indoor air drawn into the indoor section;

a supporting portion formed at a lateral end of the fan casing unit, the supporting portion supporting the cross-flow fan in the vicinity of the front of the partition;

an indoor heat exchanger arranged in front of the cross-flow fan, the indoor heat exchanger having a rear plate mounted at the rear side of the indoor heat exchanger;

a front cover mounted to the housing for covering the indoor heat exchanger and the cross-flow fan;

an outdoor heat exchanger arranged at the rear of the partition in the outdoor section; and a rear cover mounted to the housing for covering the outdoor heat exchanger;

the partition defining a scrolling portion for the cross-flow fan, the partition and the rear plate of the indoor heat exchanger defining an air guide to direct the indoor air drawn into the indoor section toward the cross-flow fan.

2. A packaged terminal air-conditioner in accordance with claim 1, wherein said fan casing unit includes side plates mounted on lateral ends of said partition and said supporting portion is formed associated with said side plates.

3. A packaged terminal air-conditioner in accordance with claim 2, wherein said supporting portion includes a bearing supporting one axis of said cross-flow fan and a motor coupled to another axis thereof.

* * * * *